US008523699B2

(12) United States Patent
Bennett

(10) Patent No.: US 8,523,699 B2
(45) Date of Patent: Sep. 3, 2013

(54) GOLF BALL LIFTER

(75) Inventor: John H. Bennett, Berkshire (GB)

(73) Assignee: Northcroft Golf Limited, Berkshire (GB)

( * ) Notice: Subject to any disclaimer, the term of this patent is extended or adjusted under 35 U.S.C. 154(b) by 0 days.

(21) Appl. No.: 13/466,260

(22) Filed: May 8, 2012

(65) Prior Publication Data

US 2012/0289355 A1 Nov. 15, 2012

(30) Foreign Application Priority Data

May 10, 2011 (GB) ..... 1107739.3

(51) Int. Cl.
*A63B 47/02* (2006.01)

(52) U.S. Cl.
USPC ..... 473/286; 294/19.2

(58) Field of Classification Search
USPC ..... 473/286, 285, 282; 294/19.2
See application file for complete search history.

(56) References Cited

U.S. PATENT DOCUMENTS 4,431,193 A * 2/1984 Nesbitt ..... 473/374
5,460,366 A 10/1995 Pugh
5,782,443 A * 7/1998 La Fontaine ..... 248/156
5,857,927 A * 1/1999 Driscoll et al. ..... 473/386
6,244,356 B1 * 6/2001 Luna ..... 172/381
2002/0169030 A1 * 11/2002 Chun-Sheng ..... 473/286
2004/0166955 A1 8/2004 Nadratowski et al.
2007/0049396 A1 3/2007 Scheibe
2007/0259731 A1 * 11/2007 Barouh ..... 473/282
2008/0261714 A1 * 10/2008 Bae ..... 473/286
2011/0053701 A1 3/2011 Eddings

OTHER PUBLICATIONS

British Search Report for corresponding British Application No. GB1107739.3 dated Jul. 22, 2011.

* cited by examiner

*Primary Examiner* — Stephen L. Blau
(74) *Attorney, Agent, or Firm* — Renner, Otto, Boisselle, & Sklar, LLP

(57) ABSTRACT

A golf ball lifting device is provided comprising: a golf ball gripper with a mechanical feature and a magnetic feature; and a gripper mount for attachment to a golf club. The mount has a mechanical feature and a magnetic feature. The mechanical and magnetic features of the gripper and mount are arranged for mutual cooperation, the mechanical and magnetic cooperation together assisting to maintain engagement between the gripper and mount when the gripper is mounted on the mount. The mount magnetic feature is arranged to enable the picking up of a magnetic golf ball marker, at least when the gripper is not mounted on the mount.

17 Claims, 3 Drawing Sheets

GOLF BALL LIFTER

TECHNICAL FIELD

The present invention relates to a device for lifting a golf ball, which device may be attached to the grip end of a golf club.

BACKGROUND

The rules of golf allow for the golf ball to be lifted from the green to allow it to be cleaned, or if it is interfering or assisting with play. Before a golf ball is lifted during play, its position must first be marked by placing a ball marker, small coin or other similar object immediately behind the ball. Ferromagnetic coins are typically used as markers. A clean ball is more predictable in putting, and since balls frequently pick up dirt during play it is often desirable to clean the ball prior to putting. Players may be required to remove a ball if it is considered that it might interfere or assist with play.

Many people who wish to continue golfing suffer from some form of physical limitations, for instance back or knee problems, which make lifting and marking balls difficult or painful. A number of devices have been developed in order to address this problem. A known arrangement is to provide a ball lifter that mechanically fits on to the end of a putter grip. In recognition of these problems, the authorities which set the rules for golf (The Royal & Ancient Golf Club of St Andrews and the United States Golf Association) have allowed such devices to be fitted to a club while it is being used provided that they do not affect the performance of the club.

U.S. Pat. No. 5,460,366 discloses a ball gripper that is removably fixed to the grip of a golf club by resiliently deformable club engaging members. Such an arrangement either requires considerable force in mounting, or is relatively insecure. This arrangement is further not capable of being used to place or recover a marker.

US2007149396 discloses a ball gripper that is magnetically attached to the grip of a golf club by a magnet disposed at the end of the grip. The present applicant has found that such an arrangement, in which the attachment of the gripper is achieved by simple magnetic attachment, is unsatisfactory. Such an approach results in either an insecure attachment, or an excessively high magnetic force which is difficult to disengage.

The present applicant has identified a need for a golf ball lifter that can be easily attached to and removed from a golf club grip, but which is secure when it is attached.

The present applicant has further identified that providing a golf ball lifter which is additionally capable of being used to place and lift a marker would be advantageous.

SUMMARY

According to a first aspect of the present invention there is provided a golf ball lifting device comprising: a golf ball gripper comprising a first mechanical feature and a first magnetic feature; and a mount for the gripper, the mount being attachable to an end of a golf club and comprising a second mechanical feature and a second magnetic feature; wherein the first and second magnetic features each comprise either a permanent magnet or ferromagnetic material and at least one of the first and second magnetic features comprises a permanent magnet; wherein the first and second mechanical features are arranged for mutual mechanical cooperation and the first and second magnetic features are arranged for mutual magnetic cooperation, the mechanical and magnetic cooperation together assisting to maintain engagement between the gripper and mount when the gripper is mounted on the mount; wherein the second magnetic feature is arranged to enable the picking up of a magnetic golf ball marker, comprising either a permanent magnet or ferromagnetic material, at least when the gripper is not mounted on the mount; wherein the first mechanical feature comprises a recess and the second mechanical feature comprises a protrusion, with the recess being adapted to receive the protrusion; and wherein the second magnetic feature forms part of the protrusion.

The first and second magnetic features may provide a magnetic force in a direction which urges the gripper and mount together. The first and second mechanical features may react forces perpendicular to the direction of the magnetic force.

The first and second mechanical features may be adapted to mechanically react forces parallel to an interface between the gripper and mount, and may further mechanically react forces perpendicular to the interface in a direction that urges the gripper and mount together. The first and second magnetic features may be adapted to provide a magnetic force perpendicular to the interface between the gripper and mount.

The first and second mechanical features may be adapted to mechanically react forces perpendicular to the direction of ball insertion into the gripper and may further mechanically react forces in the direction of ball insertion into the gripper. The first and second magnetic features may be adapted to provide a magnetic force between the gripper and mount parallel with the direction of ball insertion.

In use, the mount may be attached to the end of a golf club and the gripper may be attached to the mount. In use, the direction of ball insertion into the gripper may be parallel with the axis of the club.

The first and second mechanical features may be adapted to mechanically react forces perpendicular to the axis of the golf club when the gripper is attached to the end of a golf club with the mount, and may further mechanically react forces parallel with the club in a direction that urges the gripper and mount together. The first and second magnetic features may provide a magnetic force which is parallel to the axis of the club.

The mechanical cooperation between the first and second mechanical features may be achieved independently of the magnetic cooperation between the first and second magnetic features. In other words, the mechanical cooperation between the first and second mechanical features is such as to assist in maintaining engagement between the gripper and mount even in the absence of the first and second magnetic features, even if in practice the mechanical cooperation would not be sufficient on its own.

The first and/or second magnetic feature may comprise a magnetic plate.

The second magnetic feature may comprise a permanent magnet.

Opposite side walls of the protrusion may be arranged to be substantially parallel to one another and opposite sidewalls of the recess may be arranged to be substantially parallel to one another.

Opposite sidewalls of the protrusion may be arranged to be inclined relative to one another and opposite sidewalls of the recess may be arranged to be inclined relative to one another. The protrusion may be tapered so that the distal end is narrower than the proximal end. The recess may be tapered so that the opening is wider than the base.

The height of the protrusion may be between 3 mm and 10 mm.

The side walls of the protrusion or recess may be provided with scalloped recesses.

The first magnetic feature may be retained in the recess by a resiliently deformable lip.

The second magnetic feature may be disposed towards or at an end of the protrusion.

The mount may be attachable to the golf club by means of a screw and expanding plug fastener.

The gripper may comprise a resiliently deformable rubber or plastics material.

The gripper may comprise at least two claws which are arranged to elastically deform to grip a golf ball when pressed onto the golf ball.

The claws are curved in two directions so that each claw substantially conforms to the shape of a common ellipsoid.

Each claw may be at least 2 cm wide. The span of the claws may be at least 4 cm.

The claws may be provided with gripping lips at their distal ends.

According to a second aspect of the invention there is provided the mount of a device according to the first aspect of the present invention.

According to a third aspect of the invention there is provided the gripper of a device according to the first aspect of the present invention.

DETAILED DESCRIPTION

Figure 1:
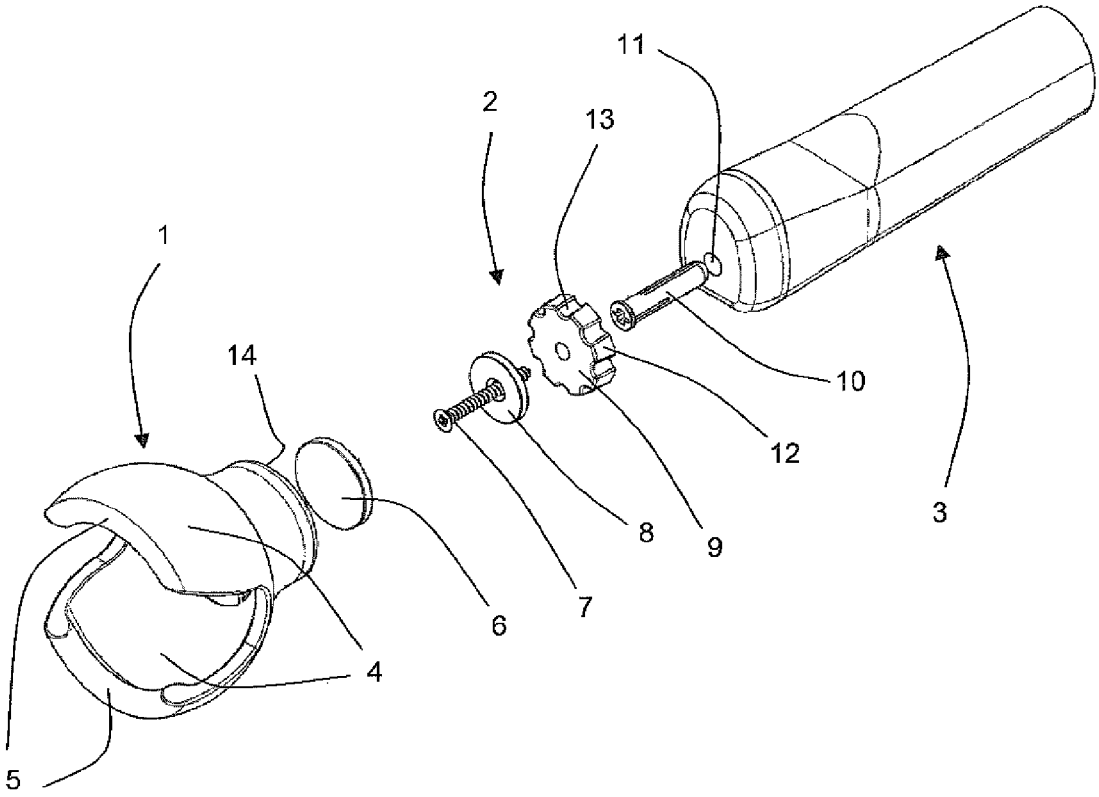
FIG. 1 is an exploded isometric diagram of an embodiment of the invention showing a gripper, mount and golf club grip.

FIG. 1 shows a ball gripper 1, a mount 2 and a club grip 3. The ball gripper 1 comprises a ferromagnetic plate 6, and two claws 4, each with lips 5. The mount 2 comprises a screw 7, magnet 8, spacer 9 and an expanding plug fastener 10. The club grip 3 includes a hole 11.

The magnet 8 is a circular disc with a central hole which is chamfered on one side and which comprises a permanent magnet, for example a neodymium based magnetic material. The spacer 9 comprises a non-magnetic material such as a plastics material and is substantially disc shaped, with a central hole. The rim of the disc of the spacer 9 is scalloped with a plurality of recesses 13 leaving a plurality of mating faces 12. The spacer 9 is tapered so that opposite mating faces 12 are slightly inclined relative to one another (and to the axis of the disc). The screw 7 is a self tapping stainless steel screw with a countersunk posidrive head. The magnet 8 and spacer 9 are stacked to form a protrusion or "magnetic peg" or "pillar". The height of the protrusion in this example embodiment is approximately 6 mm.

The gripper 1 comprises a resiliently deformable rubber or flexible plastics material and is formed with two claws 4. When the gripper 1 is gently pressed over a golf ball, the claws 4 resiliently deform, opening slightly to allow the ball to enter the gripper 1. After the lips 5 have been pushed past the widest portion of the ball, the claws 4 relax and close slightly to maintain a grip on the ball. The claws 4 are broad, being at least 2 cm wide and are curved in two directions so that they generally conform to the shape of an ellipsoid which is centred on the axis of the club shaft (in use). The span of the claws 4 is at least 4 cm.

A marker for marking the location of a ball may be placed using the mounted gripper 1 by placing the marker in the concave inner surface of one of the claws 4, and gently placing it on the ground by tipping the gripper 1. The gripper 1 may then be used to lift the ball from the ground. The gripper 1 requires very little force to engage with a ball, minimising the potential for denting the green during use.

Figure 2:
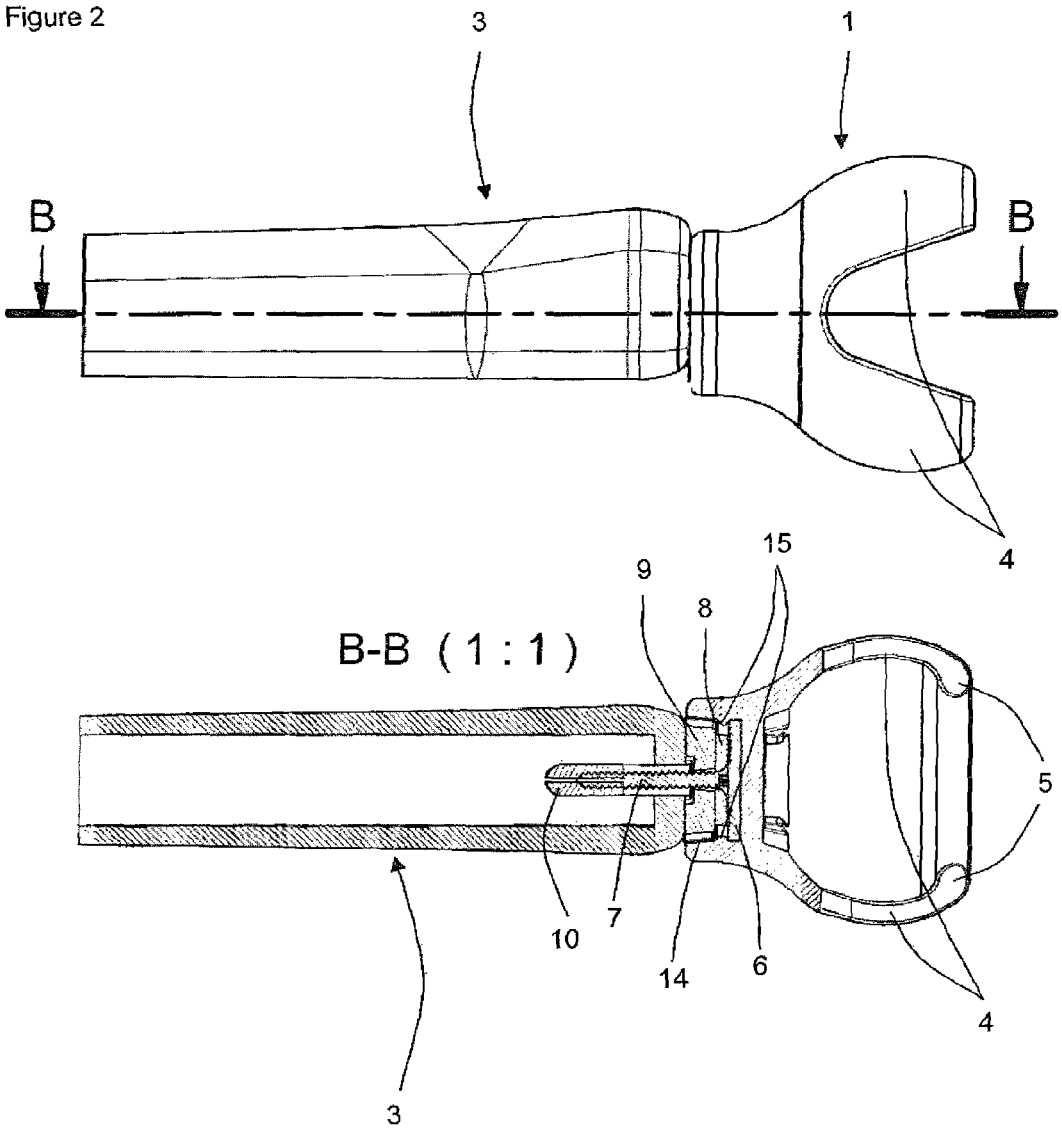
FIG. 2 is a diagram showing a side view of an embodiment of the invention assembled and attached to the club grip, and a section of the same view along BB.
Figure 3:
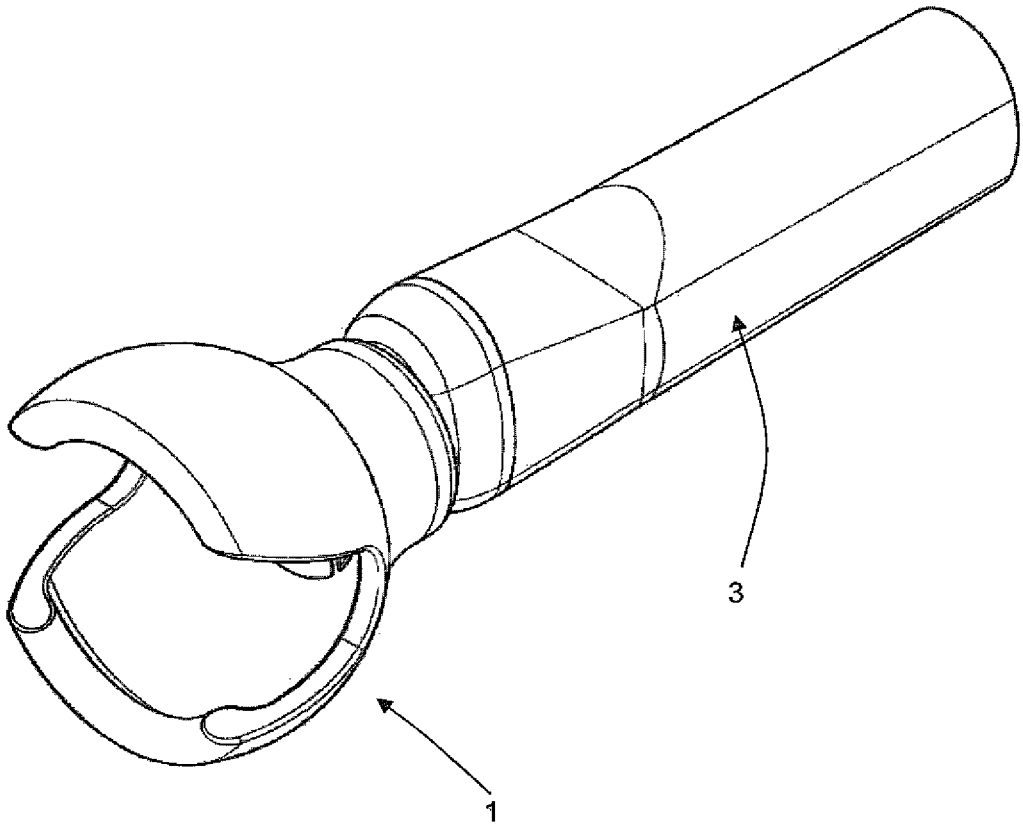
FIG. 3 is an isometric diagram of an embodiment of the assembled invention.

As can be seen in FIG. 2, the mount 2 is secured to the grip 3 by the screw 7 which cooperates with the expanding plug fastener 10 which has been inserted into the hole 11 in the grip 3. Golf club grips are typically provided with such a hole to allow air to escape when fitted to the shaft. The countersunk head of the screw 7 engages with the chamfered hole in the magnet 8, and passes through the central holes of the magnet 8 and spacer 9. The spacer 9 and magnet 8 are both smaller in width than the grip and do not protrude laterally from it when mounted. The spacer 9 is mounted so that its mating surfaces 12 taper away from the mount (and taper away from the club when the mount is attached to the club).

A recess 14 is provided in the gripper 1 with a resiliently deformable circular retaining lip 15 near the bottom to retain the ferromagnetic plate 6 in contact with the bottom of the recess 14. The recess 14 is generally cylindrical, but is slightly tapered to cooperate with the tapered mating surfaces 12 of the mounted spacer 9. The depth of the recess 14 corresponds with the combined height of the magnet 8 and spacer 9 of the mount 2, and is approximately 6 mm (from the upper surface of the ferromagnetic plate 6 to the top of the recess 14).

The gripper 1 is attached to the mount 2 by inserting the protrusion of the mount, comprising the magnet 8 and spacer 9, into the corresponding recess 14 of the gripper 1. This brings the magnet 8 into proximity with the ferromagnetic plate 6 located inside the recess 14, resulting in a magnetic force which will urge the magnet 8 and plate 6 into contact, at the same time as bringing the mating faces 12 of the spacer 9 into contact with the sidewalls of the recess 14. When mounted, the side walls of the recess 14 are resiliently deformed by the interaction of the tapered walls of the recess 14 and the mating faces 12. The scalloped recesses 13 reduce the mating force required to deform the gripper 1 sufficiently for the magnet 8 and plate 6 to achieve contact, and provide for greater resistance to rotation of the gripper 1 on the mount 2.

The recess 14 and protrusion can be considered to constitute first and second mechanical features respectively. The plate 6 and magnet 8 can be considered to constitute first and second magnetic features respectively. The upper face of the magnet 8 or the exposed face of the plate 6 in the bottom of the recess 14 can be considered to constitute the interface between the gripper and mount. When the gripper is mounted on the mount, the recess 14 and protrusion are arranged for mutual mechanical cooperation, and the plate 6 and magnet 8 are arranged for mutual magnetic cooperation. The mechanical and magnetic cooperation together assist in maintaining engagement between the gripper and the mount.

It will be appreciated that the magnet 8 of the mount 2 may readily be used to pick up golf ball markers when the gripper 1 is not attached to the mount 2, provided that the markers comprise a ferromagnetic material.

Although in this example embodiment the magnet 8 cooperates with a ferromagnetic plate 6 in the gripper, it will be appreciated that a magnet could be used in both the mount and the gripper, or a single magnet could be used in the gripper, with a ferromagnetic plate used in the mount (and with any markers comprising permanent magnets). It will further be appreciated that the protrusion may be formed on the gripper with a corresponding recess formed in the mount, and that the protrusion and recess may take other forms than a generally cylindrical shape. For example, a square or rectangular protrusion may be used. Such an arrangement may be used to react torque on the gripper.

It will further be appreciated that the protrusion and recess need not be 6 mm in height and depth respectively, and that other dimensions may be chosen. The height and depth of the protrusion and recess respectively are preferably between 1 mm and 20 mm and more preferably between 3 mm and 10 mm. Although the spacer 9 of the example embodiment is a non-magnetic material, this is not an essential feature, and it may be formed from a ferromagnetic material. A separate spacer component may be omitted entirely, with a suitably thick magnet 8 used to form the protrusion on its own.

The embodiments described above are given by way of examples only, and various other modifications will be apparent to persons skilled in the art without departing from the scope of the invention, as defined by the appended claims.

The present applicant has found that the combination of mechanical and magnetic attachment described herein is advantageous over means of attachment which are entirely magnetic or mechanical. Relying entirely on magnetic attachment alone requires a magnet that provides a very high force, which makes the subsequent removal of magnetic attachment more difficult. The removal of ferromagnetic markers from a very high strength magnet is particularly problematic. Furthermore, a smaller or thinner magnet results in reduced cost, enabling the use of low-cost non magnetic materials for the majority of the mechanical features, for example the spacer 9.

An embodiment of the present invention provides an advantageous arrangement in which the magnetic feature of the mount (the magnet 8) also acts, by forming part of the protrusion, as a mechanical feature, thereby serving both a magnetic and a mechanical function in assisting to maintain engagement between the mount and the gripper. The magnetic feature of the mount serves a further function by enabling magnetic markers to be lifted.

A device has been described that can serve several functions, not only to place and lift a marker, but also to lift a golf ball from the ground. The arrangement described allows a relatively weak magnet to be used while providing ample security of attachment for lifting golf balls and remaining easy to remove. As described above, a relatively weak magnet is more suitable for lifting markers due to the ease with which they may subsequently be removed.

The ease of removal of the gripper allows greater flexibility in the design of the gripper, and allows a relatively large width to be used without compromising the convenience of use of the device. Prior art devices which are more difficult to remove and attach to the grip must be relatively narrow so that they can more readily fit in a golf bag with other clubs. The device described herein reduces the amount of time a player with physical limitations needs to place markers and lift the ball from the ground.

The device described herein may be used as follows. The mount may remain attached to a putter on a substantially permanent basis since it does not in any way interfere with or affect the operation of the club. The gripper may be carried separately, or left attached to the putter. On reaching the green the player mounts the gripper to the putter (if it is not already mounted), and uses it to place a ferromagnetic marker. The marker is laid gently in a claw of the gripper, and the lowered to the green using the puffer, and tipped from the gripper, for instance by rotating the club on its axis. The marker may subsequently be repositioned accurately behind the ball by nudging it with the attached gripper.

Having marked the location of the ball, the player may subsequently lift the bail from the green using the mounted gripper. The gripper is gently pushed onto the ball, and the claws engage with it to allow it to be lifted, for example for cleaning.

To replace the ball, it may simply be dropped onto the green and manoeuvred into position in front of the marker using the putter blade. The gripper may be detached from the putter and the magnet of the mount on the grip of the putter may be used to lift the marker from the green. The marker may subsequently be detached from the mount, and the gripper reattached to the mount.

The device described herein substantially reduces the amount of time that is required to lift and replace a ball for a player who cannot readily bend or crouch down to carry out this operation in the conventional way. It provides for an integrated system that allows the placement and lifting of both the marker and ball, without the use of over complex mechanical mechanisms that may be unreliable or expensive.

The invention claimed is:

1. A golf ball lifting device comprising:

a golf ball gripper comprising a first mechanical feature and a first magnetic feature; and a mount for the gripper, the mount being attachable to an end of a golf club and comprising a second mechanical feature and a second magnetic feature;

wherein the first and second magnetic features each comprise either a permanent magnet or ferromagnetic material and at least one of the first and second magnetic features comprises a permanent magnet;

wherein the first and second mechanical features are arranged for mutual mechanical cooperation and the first and second magnetic features are arranged for mutual magnetic cooperation, the mechanical and magnetic cooperation together assisting to maintain engagement between the gripper and mount when the gripper is mounted on the mount;

wherein the second magnetic feature is arranged to enable the picking up of a magnetic golf ball marker, comprising either a permanent magnet or ferromagnetic material, at least when the gripper is not mounted on the mount;

wherein the first mechanical feature comprises a recess and the second mechanical feature comprises a protrusion, with the recess being adapted to receive the protrusion;

wherein the second magnetic feature forms part of the protrusion; and wherein opposite sidewalls of the protrusion are arranged to be inclined relative to one another and opposite sidewalls of the recess are arranged to be inclined relative to one another.

2. A device according to claim 1, wherein the first and second magnetic features provide a magnetic force in a direction which urges the gripper and mount together, and the first and second mechanical features react forces perpendicular to the direction of the magnetic force.

3. A device according to claim 1, wherein the first and/or second magnetic feature comprises a magnetic plate.

4. A device according to claim 1, wherein the second magnetic feature comprises a permanent magnet.

5. A device according to claim 1, wherein the first magnetic feature is retained in the recess by a resiliently deformable lip.

6. A device according to claim 1, wherein the protrusion is tapered with a distal end narrower than a proximal end, and the recess is tapered with an opening wider than a base of the recess.

7. A device according to claim 1, wherein the height of the protrusion is between 3 mm and 10 mm.

8. A device according to claim 1, wherein the second magnetic feature is disposed towards or at an end of the protrusion.

9. A device according to claim 1, wherein the mount is attachable to the golf club by means of a screw and expanding plug fastener.

10. A device according to claim 1, wherein the gripper comprises a resiliently deformable rubber or plastics material.

11. A device according to claim 1, wherein the gripper comprises at least two claws which are arranged to elastically deform to grip a golf ball when pressed onto the golf ball.

12. A device according to claim 11, wherein the claws are curved in two directions so that each claw substantially conforms to the shape of a common ellipsoid.

13. A device according to claim 11, wherein each claw is at least 2 cm wide.

14. A device according to claim 11, wherein the span of the claws is at least 4 cm.

15. A device according to claim 11, wherein the claws are provided with gripping lips at their distal ends.

16. The gripper of a device according to claim 1.

17. A golf ball lifting device comprising:

a golf ball gripper comprising a first mechanical feature and a first magnetic feature; and a mount for the gripper, the mount being attachable to an end of a golf club and comprising a second mechanical feature and a second magnetic feature;

wherein the first and second magnetic features each comprise either a permanent magnet or ferromagnetic material and at least one of the first and second magnetic features comprises a permanent magnet;

wherein the first and second mechanical features are arranged for mutual mechanical cooperation and the first and second magnetic features are arranged for mutual magnetic cooperation, the mechanical and magnetic cooperation together assisting to maintain engagement between the gripper and mount when the gripper is mounted on the mount;

wherein the second magnetic feature is arranged to enable the picking up of a magnetic golf ball marker, comprising either a permanent magnet or ferromagnetic material, at least when the gripper is not mounted on the mount;

wherein the first mechanical feature comprises a recess and the second mechanical feature comprises a protrusion, with the recess being adapted to receive the protrusion;

wherein the second magnetic feature forms part of the protrusion; and wherein the sidewalls of the protrusion or recess are provided with scalloped recesses.

* * * * *